United States Patent [19]

Porter,

[11] 4,136,497

[45] * Jan. 30, 1979

[54] INSULATING PANEL CONSTRUCTION

[75] Inventor: William H. Porter, Holland, Mich.

[73] Assignee: W. H. Porter, Inc., Holland, Mich.

[ * ] Notice: The portion of the term of this patent subsequent to Nov. 11, 1992, has been disclaimed.

[21] Appl. No.: 708,102

[22] Filed: Jul. 23, 1976

Related U.S. Application Data

[63] Continuation of Ser. No. 519,403, Oct. 31, 1974, abandoned, which is a continuation of Ser. No. 367,113, Jun. 5, 1973, abandoned, which is a continuation of Ser. No. 159,295, Jul. 2, 1971, abandoned.

[51] Int. Cl.[2] ..... E04C 2/08

[52] U.S. Cl. ..... 52/593

[58] Field of Search ..... 52/309, 593, 594, 595, 52/309.9

[56] References Cited

U.S. PATENT DOCUMENTS

| | | | |
|---|---|---|---|
| 2,021,577 | 11/1935 | Odell | 52/753 T |
| 3,274,743 | 9/1966 | Blum | 52/593 |
| 3,299,270 | 1/1967 | D'Avella | 52/595 |
| 3,330,080 | 7/1967 | Grieb | 52/309 |
| 3,372,520 | 3/1968 | Hensel | 52/483 |
| 3,719,016 | 3/1973 | Randolph | 52/593 |
| 3,879,910 | 4/1975 | Waite | 52/410 |

FOREIGN PATENT DOCUMENTS

| | | | |
|---|---|---|---|
| 1569989 | 6/1969 | France | 52/595 |

*Primary Examiner*—John E. Murtagh

*Attorney, Agent, or Firm*—Gordon W. Hueschen

[57] ABSTRACT

A prefabricated panel of substantially uniform width and thickness and having an interlocking feature comprises a foamed core slab, a rigid facing sheet bonded to the foamed core slab, and flange members integral with the facing sheet which interlock adjacent panels of the same type. Optionally, a heat-reflective liner is provided on the back side of the core slab.

6 Claims, 5 Drawing Figures

INSULATING PANEL CONSTRUCTION

This application is a continuation of Ser. No. 519,403, filed Oct. 31, 1974, now abandoned, which is in turn a continuation of Ser. No. 367,113, filed June 5, 1973, now abandoned, which is in turn a continuation of Ser. No. 159,295, filed July 2, 1971, also abandoned.

BACKGROUND OF THE INVENTION

This invention relates to paneling for insulated enclosures. In instances where it is desired to provide a refrigerated enclosure such as, for example, food processing rooms, cold rooms, milking parlors, butcher shops, slaughterhouses, and the like, a layer of insulating material is normally applied to the walls of the enclosure and then a washable liner superimposed thereover. Such construction invariably results in seams on the enclosure walls which not only provide crevices that are difficult to clean but also permit heat leakage from a relatively warmer environment into the chilled enclosure.

It is a principal object of the present invention to provide insulated paneling which obviates the heretofore encountered shortcomings and which greatly facilitates the construction of an insulated enclosure. It is a further object to provide insulated paneling that can be held in place by means of hidden fasteners. Still other objects will readily present themselves to one skilled in the art upon reference to the ensuing specification, the drawings, and the claims.

SUMMARY OF THE INVENTION

The present invention contemplates a prefabricated panel of substantially uniform width and thickness which is adapted to interlock with an adjacent abutting panel of the same type. The panel comprises a foamed core slab of an insulating material and a rigid facing sheet bonded to the slab. An integral, planar flange member is provided along one edge of the facing sheet and extends beyond an underlying end of the slab. A debossed flange member, also integral with the facing sheet, is provided along another edge thereof and substantially parallel to the planar flange member, and extends beyond an underlying end of the slab. A chamfer is provided in the foamed core slab at the end thereof and under the planar flange member, and is adapted to receive the debossed flange member of an adjacent panel of the same type, and the planar flange member is adapted to overlap a debossed flange member of an adjacent panel of the same type.

In a preferred embodiment of this invention the foamed core slab is lined with a heat-reflective material on the side opposite that bonded to the rigid facing sheet. In another preferred embodiment a rigid facing sheet is bonded to both sides of the slab. Optionally, the debossed flange member can be provided with a series of spaced openings adapted to receive fasteners such as nails, screws, or the like, therethrough.

DESCRIPTION OF THE PREFERRED EMBODIMENTS

Figure 1:
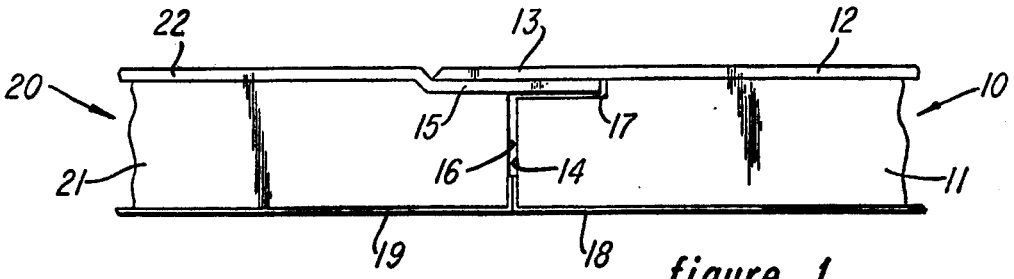
FIG. 1 is a fragmentary top view showing the joint of two abutting insulated panels of this invention.

Referring to FIG. 1, abutting insulated panels 10 and 20 are made up of foamed cores 11 and 21 to which are bonded rigid facing sheets 12 and 22, respectively. An integral planar flange member 13 is provided along one edge of facing sheet 12, extends beyond underlying end 14 of slab 11, and overlaps debossed flange member 15 of facing sheet 22. Flange member 15 is integral with facing sheet 22 and about half of it extends beyond underlying end 16 of slab 21. Chamfer 17 is provided in slab 11 under planar flange member 13 and receives debossed flange member 15.

Optionally, liners 18 and 19 made of a layer of heat-reflective material are bonded to slabs 11 and 21, respectively, and serve to provide an additional barrier for heat transmission through the insulated panels. Preferably liners 18 and 19 at least partially cover also abutting ends 14 and 16, respectively, of slabs 11 and 21.

Figure 2:
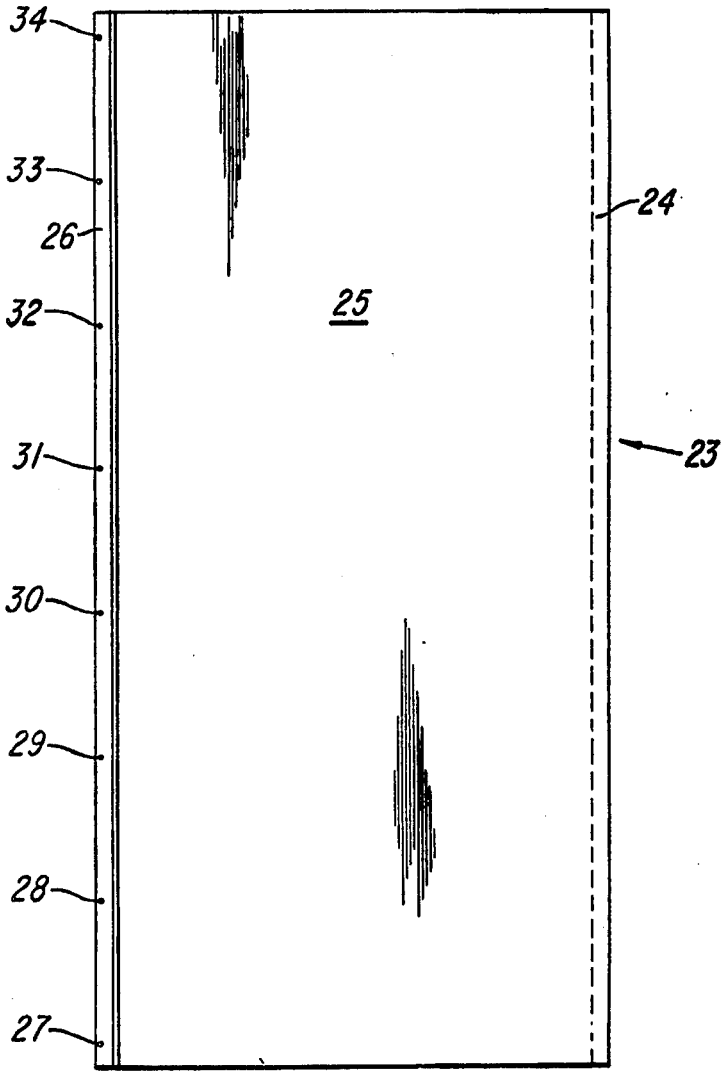
FIG. 2 is a side elevational view of an insulated panel of this invention.

Referring to FIG. 2, insulated panel 23 is provided with integral planar flange member 24 along one lateral edge of facing sheet 25 and with integral debossed flange member 26 along another lateral edge of facing sheet 25 substantially parallel to planar flange member 24. A series of spaced openings 27 through 34 can be provided in debossed flange member 26 to facilitate affixation of panel 23 to an underlying stud or similar structural support member by means of nails, screws, or the like.

The foamed core slab is preferably made of halogenated hydrocarbon-blown rigid polyurethane foam which provides a K-factor of about 0.15 upon aging. However, the particular type of material that can be used is chiefly determined by the desired insulating properties of the panel. Other suitable materials are closed-cell foamed polystyrene (K-factor equals 0.20), foam rubber, ceramic foam, and the like.

The rigid facing sheet is preferably fiberglass-reinforced polyester resin sheet; however, any other type of plastic sheet material or the like capable of withstanding the contemplated use is suitable. Other typical materials are vinyl sheets, fiberglass-reinforced vinyl sheets, and the like.

A preferred heat-reflective material for the back side of the foamed core slab is aluminum foil. If the core slab is foamed with an integral skin, the skin itself can be painted with an aluminum paint or the like, if desired.

The insulated enclosure utilizing the panels of this invention can be erected in any convenient manner. For example, a supporting frame can be erected and the panels affixed thereto with the flanges of adjacent panels interlocking as hereinabove set forth. Alternatively, the panels can be affixed as a liner to an existing wall or partition, thereby providing the requisite insulation together with a readily washable and easily maintainable wall and ceiling surface.

Affixation of the insulated panels to the supporting structure or wall can be achieved by gluing or by fasteners such as nails, screws, or the like, passing through openings such as 27 through 34 and being subsequently covered by an overlapping flange of an adjacent panel. Any remaining seam at the juncture of the overlapping flanges of two adjacent panels can be readily filled and smoothed out with a suitable caulking compound such as a silicone rubber caulking compound or the like. Also, if desired, spline means extending substantially the entire length of the panel joint can be inserted in the foamed core slabs between adjacent panels to serve as a thermal block, i.e., as a barrier to heat conduction across the panel joint.

Figure 3:
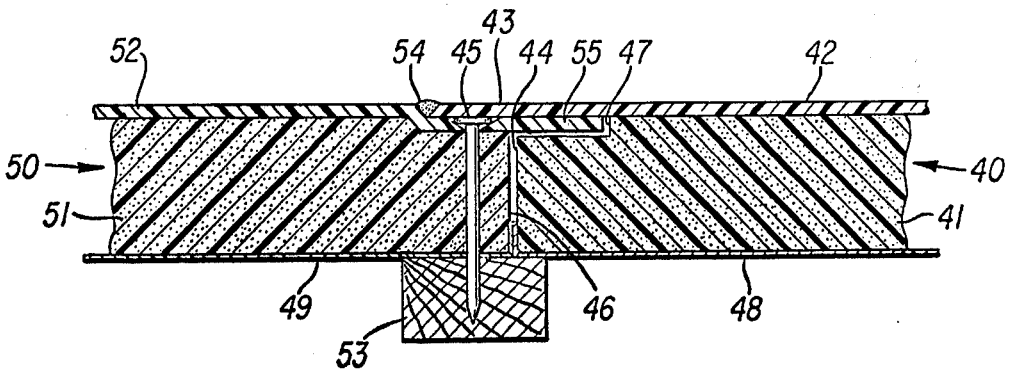
FIG. 3 is a top sectional view showing the joint of two abutting panels of this invention anchored to a stud by means of a hidden fastener.

A preferred joint formed by a combination of two abutting, interlocking panels of this invention is shown in FIG. 3. Abutting panels 40 and 50 are arranged so that planar flange member 43, integral with rigid facing sheet 42 of panel 40, overlaps debossed flange member 55 integral with rigid facing sheet 52 of panel 50. About one half of the debossed flange member 55 is supported by foamed core slab 51 and the other half extends beyond the end of the foamed core slab 51 and is received in chamfer 47 of foamed core slab 41. Liners 48 and 49 made of aluminum foil provide a heat transmission barrier, are bonded to core slabs 41 and 51, respectively, and partially overlap abutting ends 44 and 46 thereof. Fastener means such as nail 45 penetrates debossed flange member 55, core slab 51 and liner 49, and anchors panel 50 to stud 53. Panel 40 interlocks with panel 50 by receiving debossed flange member 55 in chamfer 47 and planar flange member 43 covers nail 45. The minor seam remaining at the juncture of overlapping flange members 43 and 55 is filled by laying down bead 54 of a suitable, preferably elastic, caulking compound.

Figure 4:
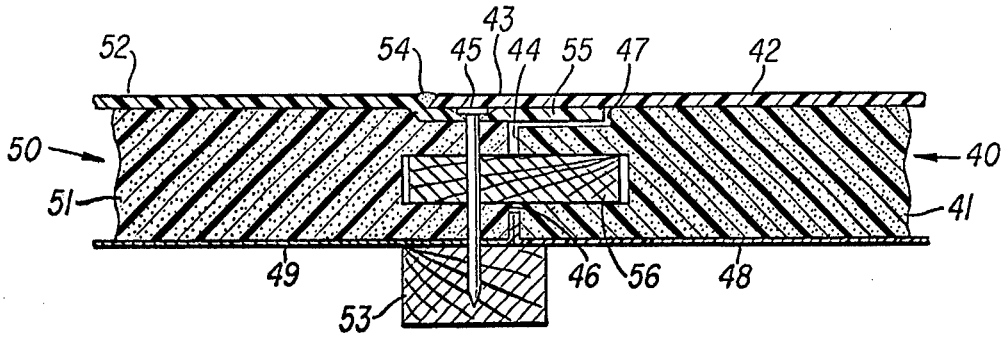
FIG. 4 is a top sectional view showing the use of a spline means.

If it is desired to provide an additional thermal block at the juncture of two adjacent panels, the joint arrangement shown in FIG. 3 can be modified as shown in FIG. 4 by providing spline means 56 which is embedded in abutting ends 44 and 46 of the respective foamed core slabs 41 and 51. Spline means 56 extends for substantially the entire length of the abutting panel edges and can be made of wood or any other material having a relatively low thermal conductivity such as a rigid foamed plastic strip or the like.

Figure 5:
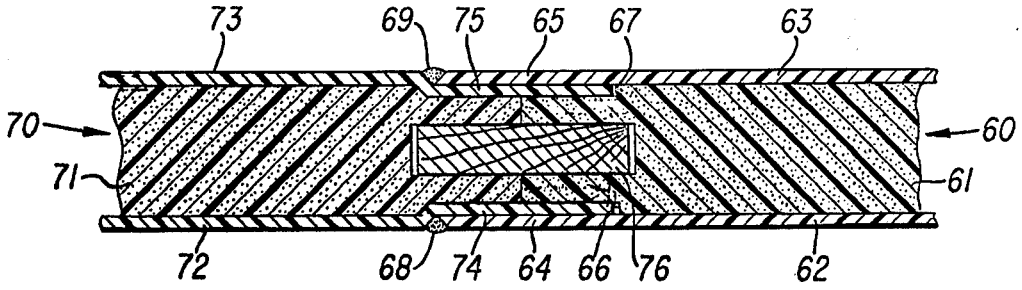
FIG. 5 is a top sectional view showing an embodiment of this invention wherein a rigid facing sheet is provided on both sides of an insulated panel.

A further embodiment of this invention, suitable for insulated partition walls or the like, is shown in FIG. 5. In this particular embodiment a rigid facing sheet is bonded to both sides of a foamed core slab. More specifically, in the joint arrangement shown panel 60 comprises foamed core slab 61 and rigid facing sheets 62 and 63 which are bonded to core slab 61 and which terminate in planar flange members 64 and 65, respectively. Chamfer 66 is provided in core slab 61 under planar flange member 64 and chamfer 67 is provided under planar flange member 65. Similarly, panel 70 comprises foamed core slab 71 and rigid facing sheets 72 and 73 which are bonded to core slab 71 and which terminate in debossed flange members 74 and 75, respectively. When panels 60 and 70 are brought together in an abutting relationship as shown in FIG. 5, debossed flange members 74 and 75 are received in chamfers 66 and 67 and are overlapped by planar flange members 64 and 65. The seam at the juncture of the overlapping flange members 64 and 74 as well as 65 and 75 is filled or smoothed out by laying down a bead of an elastic sealant or caulking compound such as beads 68 and 69. In addition, spline means 76 is imbedded in foamed core slabs 61 and 71 to provide a barrier to thermal conduction at the juncture.

The foregoing discussion and the drawings are intended as illustrative and are not to be construed as limiting. Still other variations within the spirit and scope of the present invention will readily present themselves to one skilled in the art.

I claim:

1. In combination, a plurality of abutting, interlocked prefabricated non-load-bearing, insulating panels, suitable for use in refrigerated enclosures such as food processing rooms, cold rooms, and the like, of substantially uniform width and thickness, except for a debossed area along a panel edge adapted to underlie a portion of an adjacent panel, each panel comprising a core slab of an insulating material; a rigid facing sheet bonded to the core slab on at least one side thereof; an integral sheet-form planar flange member along one edge of and consisting in an extension of the facing sheet and extending beyond an underlying one end of the core slab, the upper surface of said flange member lying in the plane of the upper surface of said facing sheet and the under surface of said flange member lying in the plane of the under surface of said facing sheet; and an integral, sheet-form, planar debossed flange member which extends along and consists in an extension of a facing sheet edge and substantially parallel to said planar flange member, said debossed member being displaced inwardly a distance equal to the thickness of said flange member so that its upper surface lies substantially in the plane of the under surface of said flange member and having a portion supported by an underlying opposite end of the core slab and another portion extending beyong the underlying opposite end of the core slab and having a width substantially the same as the supported portion thereof; said flange member, said debossed flange member, and said facing sheet being integral parts of a continuous sheet having a uniform thickness throughout its extent; said flange member being essentially co-extensive with said debossed member; said core slab along one edge of said panel being cut away directly underlying the planar flange member to form with said facing sheet a slot essentially co-extensive with the extended edge of the debossed flange member and having received therein the extended edge of a debossed flange member with substantial abutment of the core slab edges of two adjacent panels substantially at the mid-portion of the juncture formed by said flange member of one adjacent panel overlapping the debossed flange member of the other adjacent panel, with the surface of said core slab within said slot being in substantial engagement with a surface of the extended edge of said debossed flange member, and with the planar flange member of one panel overlapping the debossed flange member of an adjacent panel and engaging the outer surface only of said debossed flange member, and wherein the debossed flange member of each panel is provided with a series of spaced openings adapted to receive fasteners therethrough.

2. A prefabricated, non-load-bearing insulating panel suitable for use in refrigerated enclosures such as food processing rooms, cold rooms, and the like, having substantially uniform width and thickness, except for a debossed area along a panel edge adapted to underlie a portion of an adjacent panel, said panel being adapted to interlock with an adjacent panel of the same type, comprising a core slab of an insulating material; a rigid facing sheet bonded to the core slab on at least one side thereof; an integral, sheet-form planar flange member along one edge of and consisting in an extension of the facing sheet extending beyond an underlying one end of the core slab, the upper surface of said flange member lying in the plane of the upper surface of said facing sheet and the under surface of said flange member lying in the plane of the under surface of said facing sheet; and an integral debossed, sheet-form flange member which extends along and consists in an extension of a facing sheet edge and substantially parallel to said planar flange member, said debossed member being displaced inwardly a distance equal to the thickness of said flange member so that its upper surface lies substantially in the plane of the under surface of said flange member and having a portion supported by an underlying opposite end of the said core slab and another portion extending beyond the underlying opposite end of the core slab and having a width substantially the same as the supported portion thereof; said flange member, said debossed flange member, and said facing sheet being integral parts of a continuous sheet having a uniform thickness throughout its extent; said flange member being essentially co-extensive with said debossed member; said core slab along one edge of said panel being cut away directly underlying the planar flange member to form therewith a slot essentially co-extensive with the extended edge of the debossed flange member, and thus being adapted to receive the extended edge of a debossed flange member of an adjacent panel of the same type so as to permit substantial abutment of the core slab edges of two adjacent panels substantially at the mid-point of the juncture formed by said flange member overlapping a debossed flange member of an adjacent panel when said panels are interlocked with the surface of said core slab within said slot being adapted to engage a surface of the extended edge of the said debossed flange member; and said planar flange member being adapted to overlap a debossed flange member of an adjacent panel of the same type and to engage the outer surface only of said debossed flange when adjacent panels are interlocked, and wherein a liner of metal foil is bonded to the core slab on the side thereof opposite to that bearing the rigid facing sheet, said rigid facing sheet being relatively thick as compared with said foil.

3. The panel in accordance with claim 2 wherein the metal foil liner at least partially covers an edge of the core slab.

4. The panel in accordance with claim 2 wherein the metal foil is aluminum foil and the rigid facing sheet is fiberglass-reinforced polyester resin.

5. A prefabricated, non-load-bearing, insulating panel suitable for use in refrigerated enclosures such as food processing rooms, cold rooms, and the like, having substantially uniform width and thickness, except for a debossed area along a panel edge adapted to underlie a portion of an adjacent panel, said panel being adapted to interlock with an adjacent panel of the same type, comprising a core slab of an insulating material; a rigid facing sheet bonded to the core slab on at least one side thereof; an integral, sheet-form planar flange member along one edge of and consisting in an extension of the facing sheet extending beyond an underlying one end of the core slab, the upper surface of said flange member lying in the plane of the upper surface of said facing sheet and the under surface of said flange member lying in the plane of the under surface of said facing sheet; and an integral debossed, sheet-form flange member which extends along and consists in an extension of a facing sheet edge and substantially parallel to said planar flange member, said debossed member being displaced inwardly a distance equal to the thickness of said flange member so that its upper surface lies substantially in the plane of the under surface of said flange member and having a portion supported by an underlying opposite end of the said core slab and another portion extending beyond the underlying opposite end of the core slab and having a width substantially the same as the supported portion thereof; said flange member, said debossed flange member, and said facing sheet being integral parts of a continuous sheet having a uniform thickness throughout its extent; said flange member being essentially co-extensive with said debossed member; said core slab along one edge of said panel being cut away directly underlying the planar flange member to form therewith a slot essentially co-extensive with the extended edge of the debossed flange member, and thus being adapted to receive the extended edge of a debossed flange member of an adjacent panel of the same type so as to permit substantial abutment of the core slab edges of two adjacent panels substantially at the mid-point of the juncture formed by said flange member overlapping a debossed flange member of an adjacent panel when said panels are interlocked with the surface of said core slab within said slot being adapted to engage a surface of the extended edge of the said debossed flange member; and said planar flange member being adapted to overlap a debossed flange member of an adjacent panel of the same type and to engage the outer surface only of said debossed flange when adjacent panels are interlocked, and wherein the debossed flange member is provided with a series of spaced openings adapted to receive fasteners therethrough.

6. In combination, a plurality of abutting, interlocked prefabricated non-load-bearing, insulating panels, suitable for use in refrigerated enclosures such as food processing rooms, cold rooms, and the like, of substantially uniform width and thickness, except for a debossed area along a panel edge adapted to underlie a portion of an adjacent panel, each panel comprising a core slab of an insulating material; a rigid facing sheet bonded to the core slab on at least one side thereof; an integral, sheetform planar flange member along one edge of and consisting in an extension of the facing sheet and extending beyond an underlying one end of the core slab, the upper surface of said flange member lying in the plane of the upper surface of said facing sheet and the under surface of said flange member lying in the plane of the under surface of said facing sheet; and an integral, sheetform, planar debossed flange member which extends along and consists in an extension of a facing sheet edge and substantially parallel to said planar flange member, said debossed member being displaced inwardly a distance equal to the thickness of said flange member so that its upper surface lies substantially in the plane of the under surface of said flange member and having a portion supported by an underlying opposite end of the core slab and another portion extending beyond the underlying opposite end of the core slab and having a width substantially the same as the supported portion thereof; said flange member, said debossed flange member, and said facing sheet being integral parts of a continuous sheet having a uniform thickness throughout its extent; said flange member being essentially co-extensive with said debossed member; said core slab along one edge of said panel being cut away directly underlying the planar flange member to form with said facing sheet a slot essentially co-extensive with the extended edge of the debossed flange member and having received therein the extended edge of a debossed flange member with substantial abutment of the core slab edges of two adjacent panels substantially at the mid-portion of the juncture formed by said flange member of one adjacent panel overlapping the debossed flange member of the other adjacent panel, with the surface of said core slab within said slot being in substantial engagement with a surface of the extended edge of said debossed flange member, and with the planar flange member of one panel overlapping the debossed flange member of an adjacent panel and engaging the outer surface only of said debossed flange member, and wherein a liner of metal foil is bonded to the core slab of each panel on the side thereof opposite to that bearing the rigid facing sheet, said rigid facing sheet being relatively thick as compared with said foil.

* * * * *